US012515722B2

(12) United States Patent
Lill et al.

(10) Patent No.: US 12,515,722 B2
(45) Date of Patent: Jan. 6, 2026

(54) RAIL PLANNING SYSTEM

(71) Applicant: Technological Resources Pty. Limited, Melbourne (AU)

(72) Inventors: Kevin Lill, Perth (AU); James Papanastasiou, Melbourne (AU); Dirk Terblanche, Ocean Reef (AU); Chintana Meegamarachchi, Wilson (AU); Jonathan J. M. Wan, Melbourne (AU)

(73) Assignee: TECHNOLOGICAL RESOURCES PTY LIMITED, Melbourne (AU)

( * ) Notice: Subject to any disclaimer, the term of this patent is extended or adjusted under 35 U.S.C. 154(b) by 291 days.

(21) Appl. No.: 18/014,088

(22) PCT Filed: Jun. 30, 2021

(86) PCT No.: PCT/AU2021/050695
§ 371 (c)(1),
(2) Date: Dec. 30, 2022

(87) PCT Pub. No.: WO2022/006622
PCT Pub. Date: Jan. 13, 2022

(65) Prior Publication Data

US 2023/0278608 A1 Sep. 7, 2023

(30) Foreign Application Priority Data

Jul. 6, 2020 (AU) ..... 2020902314

(51) Int. Cl.
*B61L 27/12* (2022.01)

(52) U.S. Cl.
CPC ..... *B61L 27/12* (2022.01)

(58) Field of Classification Search
CPC ..... B61L 27/12; B61L 25/08; B61L 21/06; B61L 25/028
See application file for complete search history.

(56) References Cited

U.S. PATENT DOCUMENTS 5,659,734 A * 8/1997 Tsuruta ..... B61L 27/14
9,950,722 B2 * 4/2018 Kumar ..... B61L 27/40
(Continued)

FOREIGN PATENT DOCUMENTS

AU 2013270604 A1 7/2014
AU 2019283858 A1 1/2020
(Continued)

OTHER PUBLICATIONS

Jul. 21, 2021—(WO) International Search Report—App PCT/AU2021/050695.

(Continued)

*Primary Examiner* — Peter D Nolan
*Assistant Examiner* — Anwar Mohamed
(74) *Attorney, Agent, or Firm* — Banner & Witcoff, Ltd.

(57) ABSTRACT

A rail planning system for planning movement of trains is disclosed. At least some trains comprising a plurality of containers and each container includes at least one train appliance. The system comprises a data storage device arranged to store container data indicative of the or each appliance associated with each container, and planned future locations of the containers. The system is arranged to produce data indicative of a train graph for display, the train graph including a line for each container, each line indicative of the planned locations in time and space of a container, and the system includes an interface arranged to facilitate modification by a user of the planned location of a container and thereby modification of the line associated with the container on the train graph.

20 Claims, 12 Drawing Sheets

(56) References Cited

U.S. PATENT DOCUMENTS

| | | | | |
|---|---|---|---|---|
| 10,572,850 | B2 * | 2/2020 | Johnson | B61L 25/028 |
| 12,157,509 | B2 * | 12/2024 | Vujanic | B61L 27/20 |
| 2014/0034787 | A1 | 2/2014 | Ueda | |
| 2020/0055526 | A1 * | 2/2020 | Malik | B61G 3/20 |

FOREIGN PATENT DOCUMENTS

| | | | |
|---|---|---|---|
| AU | 2020286205 | A1 | 1/2021 |
| GB | 2507163 | A | 4/2014 |

OTHER PUBLICATIONS

Aug. 19, 2020—(AU) International Type Search Report—App 2020902314.
May 31, 2022—(WO) International Preliminary Report on Patentability—App PCT/AU2021/050695.

* cited by examiner

250

| 252 APPLIANCE TYPE | 254 YARD | 256 ID | 258 APPLIANCE NAME |
|---|---|---|---|
| Tag | 100 | 1 | Tag002 |
| Tag | 100 | 2 | Tag094 |
| | | ... | |
| Tag | 100 | 19 | |
| Tag | 100 | 20 | |
| NonTag | 100 | 1 | |
| NonTag | 100 | 2 | NonTag001 |
| | | ... | |
| NonTag | 100 | 5 | |
| NonTag | 100 | 6 | |
| LocoSet | 100 | 1 | 8157, 8152, 7064,, |
| | | | |
| LocoSet | 100 | 2 | 7083, 7048, 7089 |
| | | ... | |
| LocoSet | 100 | 33 | |
| LocoSet | 100 | 34 | |
| BrakeCarSet | 100 | 1 | CB01,, |
| BrakeCarSet | 100 | 2 | |
| | | ... | |
| BrakeCarSet | 100 | 14 | |
| BrakeCarSet | 100 | 15 | |

260

| 262 ID | 264 POSITION | 266 YARD | 268 APPLIANCE NUMBER | 270 APPLIANCE NAME | 272 IS SOUTH CONNECTED | 274 IS NORTH CONNECTED | 276 SOUTH APPLIANCE | 278 NORTH APPLIANCE | 280 APPLIANCE TYPE | 282 X POSITION OFFSET | 284 Y POSITION OFFSET |
|---|---|---|---|---|---|---|---|---|---|---|---|
| 1 | NTP_7M_91 | 200 | 1 | CB01,, | 0 | 0 | | | BrakeCarSet | 67 | 0 |
| 2 | TP_7M_5 | 200 | 1 | IC13,, | 0 | 1 | | Tag004 | BrakeCarSet | -65 | 0 |
| 1 | NTP_7M_90 | 200 | 1 | 8122, 7074, 7067, 9407, 7085 | 0 | 0 | | | LocoSet | -2 | 0 |
| 2 | TP_3M_3 | 200 | 2 | 9430, 9101, 9408,, | 1 | 0 | Tag041 | | LocoSet | 113 | 0 |
| 3 | TP_DumpCD4P | 200 | 2 | 9112, 9434, 8173,, | 1 | 0 | Tag026 | | LocoSet | 113 | 0 |
| 4 | TP_Dugite_Pass | 200 | 2 | 8110, 7072, 8169,, | 1 | 0 | Tag044 | | LocoSet | 113 | 0 |
| 5 | TP_ArrCD3P | 200 | 2 | 8183, 7076, 9402,, | 1 | 0 | Tag036 | | LocoSet | 113 | 0 |
| 6 | TP_Dove_Main | 200 | 2 | 8164, 9107, 8179,, | 1 | 0 | Tag009 | | LocoSet | 113 | 0 |
| 7 | TP_7M_5 | 200 | 3 | 7067, 9407, 7085,, | 1 | 0 | Tag004 | | LocoSet | 130 | 0 |
| 9 | TP_Dingo_South | 200 | 1 | 8129, 8133, 8131,, | 0 | 0 | | | LocoSet | 32 | 0 |
| 10 | TP_7M-7 | 200 | 2 | 7062, 7082, 8100,, | 1 | 0 | Tag015 | | LocoSet | 113 | 0 |
| 11 | TP_8M_82 | 200 | 2 | 9116, 8187, 7088,, | 1 | 0 | Tag018 | | LocoSet | 113 | 0 |
| 1 | NTP_7M_38 | 200 | 1 | NonTag002 | 0 | 0 | | | NonTag | 5 | 0 |
| 2 | NTP_Unknown2 | 200 | 1 | NonTag001 | 0 | 0 | | | NonTag | 5 | 0 |
| 1 | TP_7M_3 | 200 | 1 | Tag041 | 0 | 1 | | 9430, 9101, 9408,, | Tag | -47 | 0 |
| 2 | TP_DumpCD4P | 200 | 1 | Tag026 | 0 | 1 | | 9112, 9434, 8173,, | Tag | -47 | 0 |
| 3 | TP_Dugite_Pass | 200 | 1 | Tag044 | 0 | 1 | | 8110, 7072, 8169,, | Tag | -47 | 0 |
| 4 | TP_ArrCD3P | 200 | 1 | Tag036 | 0 | 1 | | 8183, 7076, 9402,, | Tag | -47 | 0 |
| 5 | TP_Dove_Main | 200 | 1 | Tag009 | 0 | 1 | | 8164, 9107, 8179,, | Tag | -47 | 0 |
| 6 | TP_7M_5 | 200 | 2 | Tag004 | 1 | 1 | IC13,, | 7067, 9407, 7085,, | Tag | -30 | 0 |
| 7 | TP_7M_7 | 200 | 1 | Tag015 | 0 | 1 | | 7062, 7082, 8100,, | Tag | -47 | 0 |
| 9 | TP_8M_82 | 200 | 1 | Tag018 | 0 | 1 | | 9116, 8187, 7088,, | Tag | -47 | 0 |

*Figure 13*

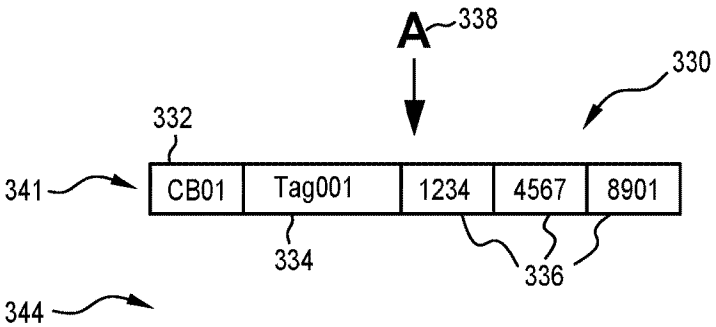

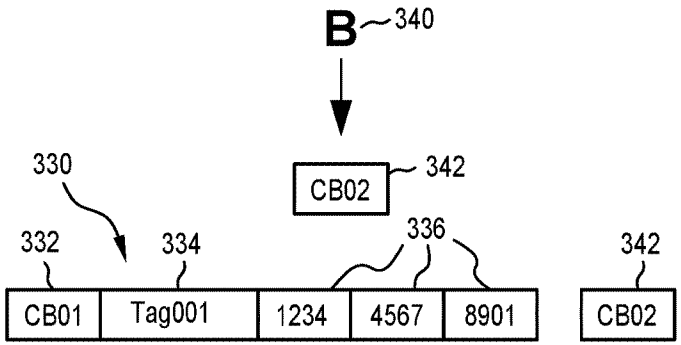

350

| 264 POSITION | 266 YARD | 268 APPLIANCE NUMBER | 270 APPLIANCE NAME | 272 IS CONNECTED |
|---|---|---|---|---|
| Position A | 100 | 1 | CB01,, | 1 |
| Position A | 100 | 2 | Tag001 | 1 |
| Position A | 100 | 3 | 1234, 4567, 8901,, | 0 |
| Position A | 100 | 4 | | 0 |
| Position A | 100 | 5 | | 0 |
| Position A | 100 | 6 | | 0 |
| Position B | 100 | 1 | CB02,, | 0 |
| Position B | 100 | 2 | | 0 |
| Position B | 100 | 3 | | 0 |
| Position B | 100 | 4 | | 0 |
| Position B | 100 | 5 | | 0 |
| Position B | 100 | 6 | | 0 |

352

| 264 POSITION | 266 YARD | 268 APPLIANCE NUMBER | 270 APPLIANCE NAME | 272 IS CONNECTED |
|---|---|---|---|---|
| Position A | 100 | 1 | | 0 |
| Position A | 100 | 2 | | 0 |
| Position A | 100 | 3 | | 0 |
| Position A | 100 | 4 | | 0 |
| Position A | 100 | 5 | | 0 |
| Position A | 100 | 6 | | 0 |
| Position B | 100 | 1 | CB01,, | 1 |
| Position B | 100 | 2 | Tag001 | 1 |
| Position B | 100 | 3 | 1234, 4567, 8901,, | 0 |
| Position B | 100 | 4 | CB02,, | 0 |
| Position B | 100 | 5 | | 0 |
| Position B | 100 | 6 | | 0 |

*Figure 16*

RAIL PLANNING SYSTEM

CROSS-REFERENCE TO RELATED APPLICATIONS

The present application is a U.S. National Phase Entry under 35 U.S.C. § 371 of International PCT Application No. PCT/AU2021/050695 having an international filing date of Jun. 30, 2021, which claims priority to Australian Application 2020902314 filed Jul. 6, 2020. Benefit of the filing date of each of these prior applications is hereby claimed. Each of these applications is hereby incorporated by reference in its entirety.

FIELD OF THE INVENTION

The present invention relates to a rail planning system for planning and managing movement of trains, and in particular to a rail planning system for planning and managing movement of trains in a rail yard of a rail network.

BACKGROUND OF THE INVENTION

It is known for a large scale mine operation to include one or more mine sites that produce one or more bulk commodities, one or more ports for shipping the bulk commodities to customers, and a rail network that interconnects and transports the bulk commodities from the mine site(s) to the port(s). Typically, the rail network includes multiple trains that travel between the mine site(s) and the port(s), and each train has several appliances that may include at least one locomotive appliance and a large number of rail cars typically referred to collectively as a 'tag'. In this specification, an 'appliance' means any component of a train, and a 'container' is a set of appliance types. For example, an 'appliance' may be a locomotive, a rail car or a brake car, and a container may include one or more locomotives, one or more rail cars or one or more brake cars.

Planning and management of train movements is typically relatively simple when the train is travelling along a main line between a mine and a port. However, when the train arrives at a port yard, the train appliances may be required to separate, for example so that maintenance can be carried out on the locomotive(s), so that the locomotive(s) may be refueled, and so that material in the tag can be unloaded. It may also be necessary to temporarily attach a brake car to a tag, or to attach a temporary locomotive to the tag whilst the tag is at the yard. Such complex movements of appliances are currently planned and managed in a substantially manual way, which is inefficient and cumbersome.

SUMMARY OF THE INVENTION

In accordance with a first aspect of the present invention, there is provided a rail planning system for planning movement of trains, at least some trains comprising a plurality of containers, each container including at least one train appliance, the system comprising:

- a data storage device arranged to store container data indicative of:
  - the or each appliance associated with each container; and
  - planned future locations of the containers;
- the system arranged to produce data indicative of a train graph for display, the train graph including a line for each container, each line indicative of the planned locations in time and space of a container; and

- the system including an interface arranged to facilitate modification by a user of the planned location of a container and thereby modification of the line associated with the container on the train graph.

In an embodiment, the interface is arranged to enable a user to attach a first container to a second container, and to facilitate modification of the planned location of the first and second containers together.

In an embodiment, the interface is arranged to enable a user to detach a first container from a second container so that the planned location of the first and second containers are modifiable separately.

In an embodiment, the interface is arranged to enable a user to simultaneously lock or unlock one or more lines on the train graph, wherein each locked line is indicative of a container movement that is considered to be finalised for implementation, and each unlocked line is indicative of a container movement that is contemplated but has not yet been finalised for implementation.

In an embodiment, a line on the train graph is lockable by user selection of a location on the line, wherein the selection location on the line corresponds to a defined time, and the system is arranged such that all locations on the line corresponding to a previous time to the defined time are also locked.

In an embodiment, locked portions of a line on the train graph are represented differently to unlocked portions of the line, such as in a different colour or in bold font.

In an embodiment, at least one line on the train graph is also indicative of past locations of a container.

In an embodiment, the interface is arranged to facilitate modification by a user of the planned location of a container and thereby modification of the line on the train graph associated with the container by facilitating movement of a displayed line on the train graph using a human interface device.

In an embodiment, the interface is arranged to facilitate modification by a user of the planned location of a container and thereby modification of the line on the train graph associated with the container using a dialog box.

In an embodiment, the container data includes an appliance number for each container, the appliance number indicative of the position order of a container at a location.

In an embodiment, the container data includes data indicative of:

- the type of appliance in a container;
- a label for each appliance in the container;
- information indicative of whether the container is connected to another container at a first end of the container;
- information indicative of whether the container is connected to another container at a second opposite end of the container; and/or
- information indicative of a yard at which the container is located.

In an embodiment, the train graph includes a time x-axis and a distance y-axis, wherein diagonally extending lines represent movement, horizontal lines represent no movement, and vertical lines represent movement across fork locations.

In an embodiment, the train graph includes locations on the distance axis corresponding to a 'yard in' location, a 'dumper' location, a 'yard out' location, a 'refueling' location, and/or a 'brake car spur' location.

In an embodiment, each appliance comprises:

- at least one locomotive;
- a plurality of rail cars loadable with material; or
- at least one brake car.

In an embodiment, the train graph includes:

a line indicative of planned locations of a main line locomotive container;

a line indicative of planned locations of a rail car container;

a line indicative of planned locations of a yard locomotive container; and/or a line indicative of planned locations of a brake car container.

In an embodiment, the train graph includes a now line indicative of locations of containers at a current time.

In an embodiment, the train graph includes a stub line portion indicative of a direction of travel of a container as the container moves to a new location.

In an embodiment, the system is arranged to store configuration data indicative of display characteristics of the train graph. The configuration data may include data indicative of:

x-axis timescale;

y-axis scale;

labels for y-axis locations;

colour of each line;

unlocked line style;

locked line style;

line text and line text position relative to a line; and/or section group colour, each section indicative of a different branch from a common fork location.

In an embodiment, at least some of the configuration data is modifiable by a user.

In an embodiment, the system includes at least one application programming interface (API) arranged to facilitate access to the data stored in the data storage device by an external computing device.

In an embodiment, the system includes a plurality of sensing devices arranged to sense locations of containers, the sensed locations being used by the system to update the current locations of the containers on the train graph.

In an embodiment, the system is arranged to display a train control screen that displays a representation of available container locations and provides a snapshot of the locations of containers at a selected time.

In accordance with a second aspect of the present invention, there is provided a method of planning movement of trains, at least some trains comprising a plurality of containers, each container including at least one train appliance, the method comprising:

storing container data indicative of:

the or each appliance associated with each container; and planned future locations of the containers;

displaying a train graph that includes a line for each container, each line indicative of the planned locations in time and space of a container; and facilitating modification by a user of the planned location of a container using an interface and thereby modification of the line associated with the container on the train graph.

BRIEF DESCRIPTION OF THE DRAWINGS

The present invention will now be described, by way of example only, with reference to the accompanying drawings, in which:

FIG. 13 is a representation of an example position table of the system shown in FIG. 1;

FIG. 16 is a diagrammatic representation illustrating movement of a train and associated changes that are made to fields of a position table of the system shown in FIG. 1.

DESCRIPTION OF AN EMBODIMENT OF THE INVENTION

Figure 1:
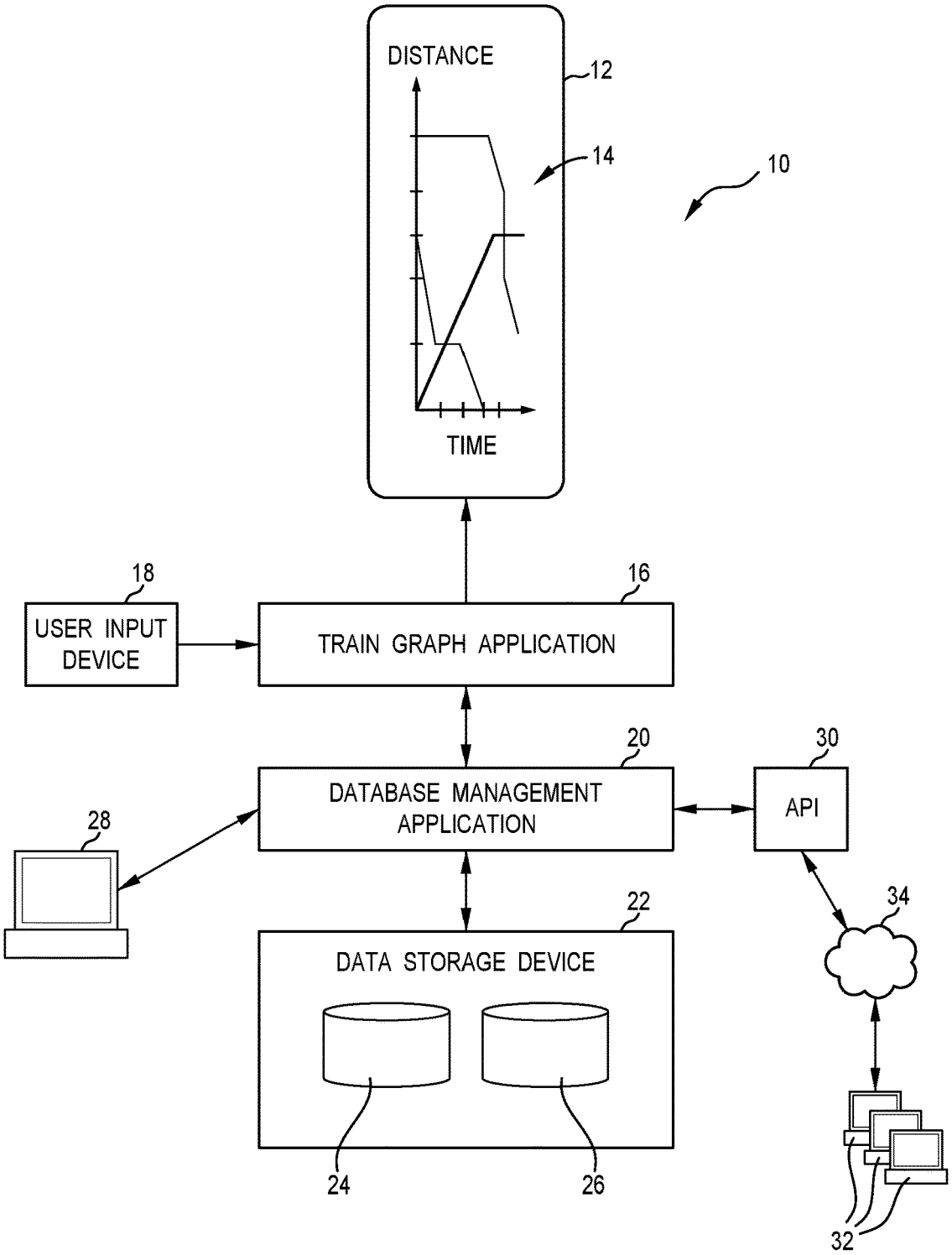
FIG. 1 is a schematic conceptual diagram illustrating a rail planning system according to an embodiment of the present invention.

The following embodiments are described in relation to a rail planning system (and associated method) for planning and managing movement of train appliances at a rail yard, although it will be understood that other applications of the rail planning system other than for a rail yard are envisaged. Referring to FIG. 1, there is shown a conceptual diagram of a rail planning system 10 usable to plan and manage movements of trains, and in particular appliances of trains, at a yard for example disposed at a port.

The planning system 10 is for particular use in a mine operation that includes at least one mine site producing a bulk commodity, at least one port for loading the bulk commodity onto ships, a rail network that connects the mine site(s) to the port(s), and several trains that travel on the rail network and transport the bulk commodity from the mine site(s) to the port(s). However, it will be appreciated that other applications are envisaged.

In the present example, the bulk commodity produced by the mine site(s) is iron ore, although it will be understood that any other bulk commodity is envisaged.

The planning system 10 includes a display 12 arranged to display a train graph 14, in this example a yard train graph 14, usable by a yard planner to plan and manage movements of trains at a yard, and in particular to plan and manage movements of train appliances at the yard.

The system 10 also includes a train graph application 16 arranged to coordinate and implement planning and management of movements of train appliances in response to user input received from a user input device 18 that may include a keyboard and mouse and/or a touch screen associated with the display 12. The train graph application 16 may be implemented using any suitable computing device (not shown).

The system 10 also includes a database management application 20 that interfaces between the train graph application 16 and a data storage device 22, the database management application 20 coordinating addition of data associated with train planning to the data storage device 22 and extraction of data from the data storage device 22. In this example, the data storage device 22 is arranged to store configuration data 24 indicative of defined aspects of the displayed yard train graph, including the colour and size of lines shown on the train graph, as described in more detail below; and container data 26 indicative of the train appliances at the yard, including data identifying the appliance and data indicative of the location of the appliance at the yard.

In this example, the system is used by a yard planner responsible for managing and planning movements of train appliances, in particular after the trains have arrived at a port yard, the yard planner defining a future plan for the times and locations of train appliance movements at the port yard.

In this example, the system 10 is also accessible by a train controller, in this example using a train controller terminal 28. The train controller is responsible for safely implementing train movements according to the plan defined by the yard planner. In a mine operation that includes autonomous trains, safe movement of trains is typically achieved by issuing train Movement Authorities that define specific allowed train movements, although it will be understood that other arrangements are possible.

In this example, the system 10 also includes at least one application programming interface (API) 30 arranged to facilitate access to the data stored in the data storage device 22, for example by external computing devices 32 through a wide area network such as the Internet 34.

Figure 2:
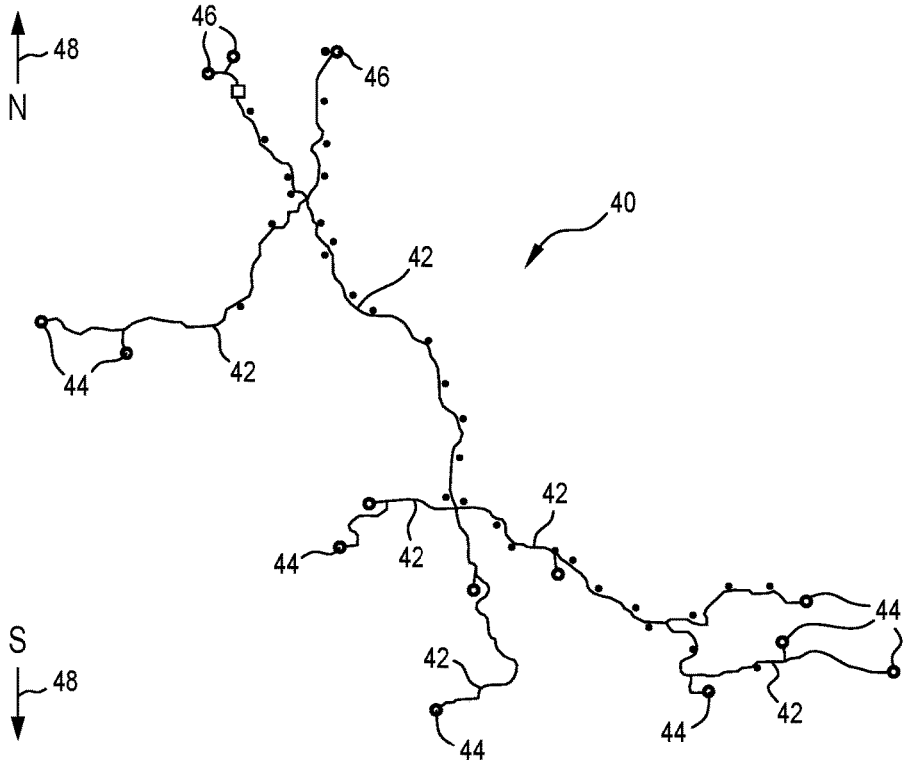
FIG. 2 is a diagrammatic representation of an example rail network that extends between mine site(s) and port(s) of a mine operation.

An example rail network 40 is represented in FIG. 2, the rail network including multiple train lines 42 connecting multiple mine sites 44 to multiple ports 46. As indicated by direction arrows 48, in this example the mine sites 44 are disposed at locations generally south of the ports 46.

Figure 3:
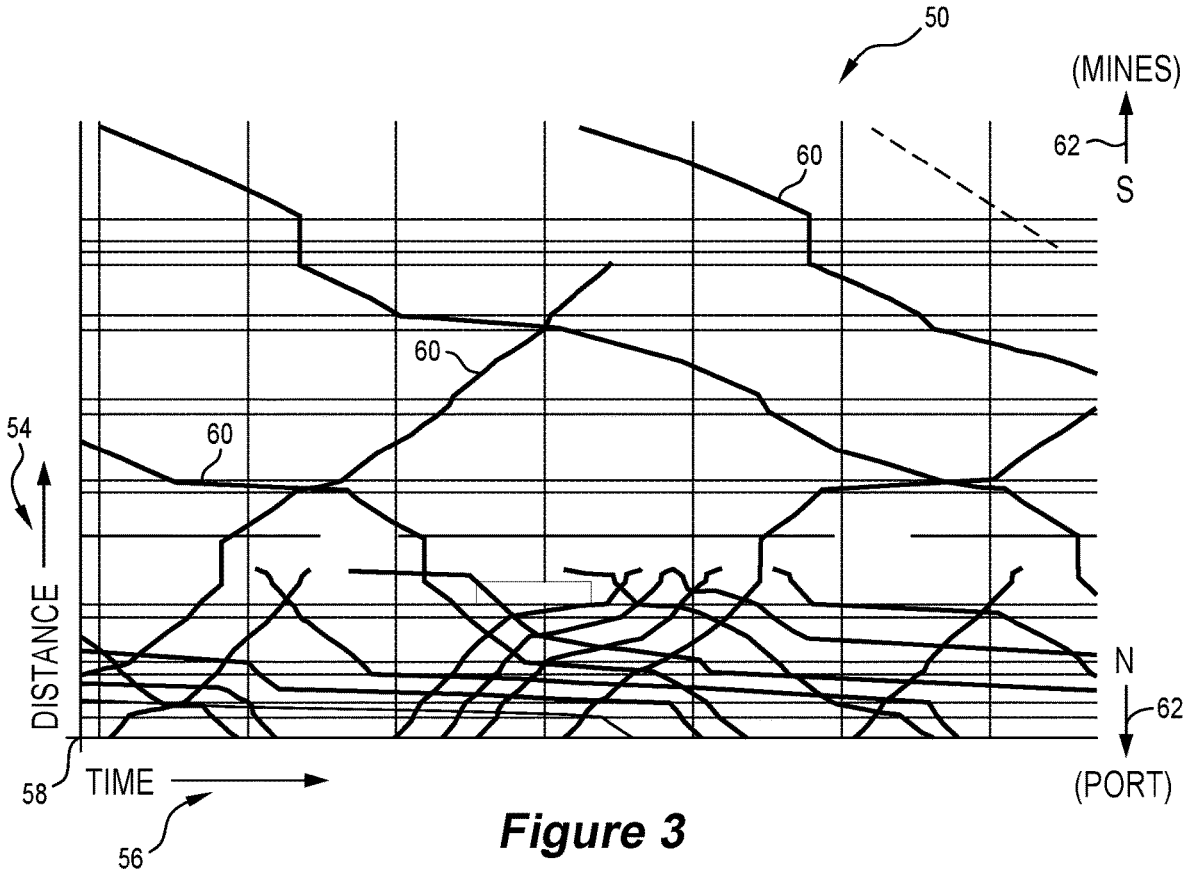
FIG. 3 is a representation of an example main line train graph usable to manage and plan train movements on a main line of the rail network shown in FIG. 2.

An example main line train graph 50 usable to manage and plan train movements between the mine sites 44 and the ports 46 is shown in FIG. 3.

The main line train graph 50 includes a y-axis 54 representing distance from a port 46, and an x-axis 56 representing time. Origin 58 represents the port location and therefore 0 km. The main line train graph 50 also includes direction arrows 62 indicating that increasing distance (upwards) from the port 46 corresponds to movement from north to south.

It will be appreciated that since the main line train graph 50 uses the port location as the origin for the y-axis 54, the main line train graph 50 shows South above North, unlike the rail network representation 40 shown in FIG. 2 which shows North above South.

In the example shown in FIG. 2, the rail network 40 includes single track sections and double track sections. Each single track section typically includes multiple sidings that serve to permit trains travelling in opposite directions to pass each other.

Typically, the rail network 40 will include many trains at any given time, and accordingly in order to avoid collisions whilst maximizing train throughput it is necessary to carefully manage movement of the trains on the rail network and at a port yard.

Figure 4:
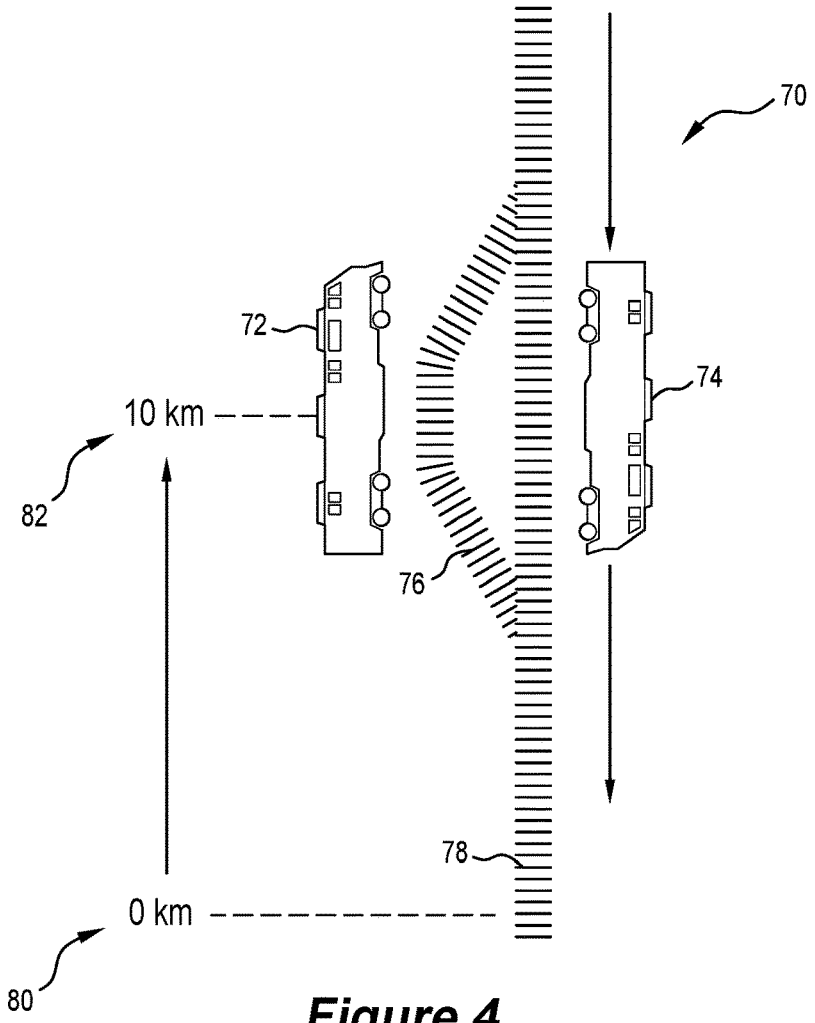
FIG. 4 is a diagrammatic representation of a portion of an example rail track showing positions of 2 trains as the trains move along a main line of a rail network.

An example representation of a portion 70 of a train line is shown in FIG. 4. The train line portion 70 includes a first train 72 and a second train 74, the first train 72 travelling away from a port but currently stationary on a siding 76 and the second train 74 travelling on a main line section 78 towards the port. The port location is represented in FIG. 4 by origin location 80, and the siding is located at a distance 10 km from the port.

Figure 5:
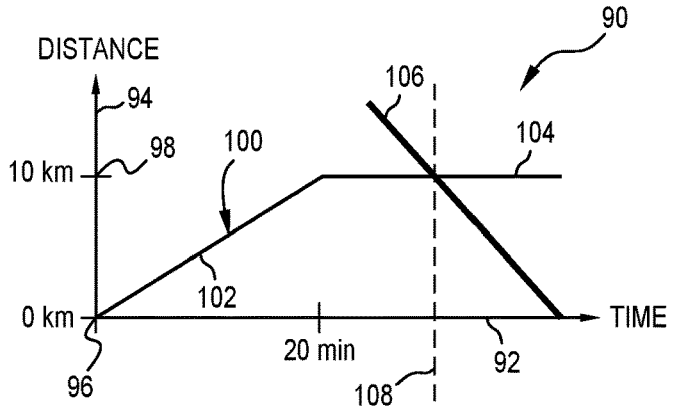
FIG. 5 is an example conventional train graph usable to plan and manage movements of the example trains on the rail network shown in FIG. 4.

A simple conventional train graph 90 representing the train line portion 70 shown in FIG. 4 is shown in FIG. 5.

The train graph 90 includes a time axis 92, a distance axis 94, an origin (port) location 96 and a 10 km location 98. The train graph 90 also includes a first train line 100 representing movement in time and space of the first train 72, and a second train line 106 representing movement in time and space of the second train 74. Also shown on the train graph 90 is a now line 108 representing the locations of the trains at the current time, and therefore portions of the first and second train lines 100, 106 to the left of the now line 108 represent past locations of the trains, and portions of the first and second train lines 100, 106 to the right of the now line 108 represent future locations of the trains and therefore planned movements of the first and second trains 72, 74.

As shown in FIG. 5, the first train line 100 includes a first line portion 102 that represents movement of the first train 72 from the 0 km location 96 (the port) to the siding 76 in a direction away from the port, then no movement of the first train 72 as the first train 72 is stationary at the siding 76. The second train line 106 represents movement of the second train 74 towards the port, the second train 74 passing the siding 76 at the 10 km location 98 and the second train planned to subsequently continue to move toward the port.

It will be appreciated that the representation of the train line portion 70 shown in FIG. 4 represents the respective locations of the first and second trains 72, 74 at the current time represented by the now line 108.

Figure 6:
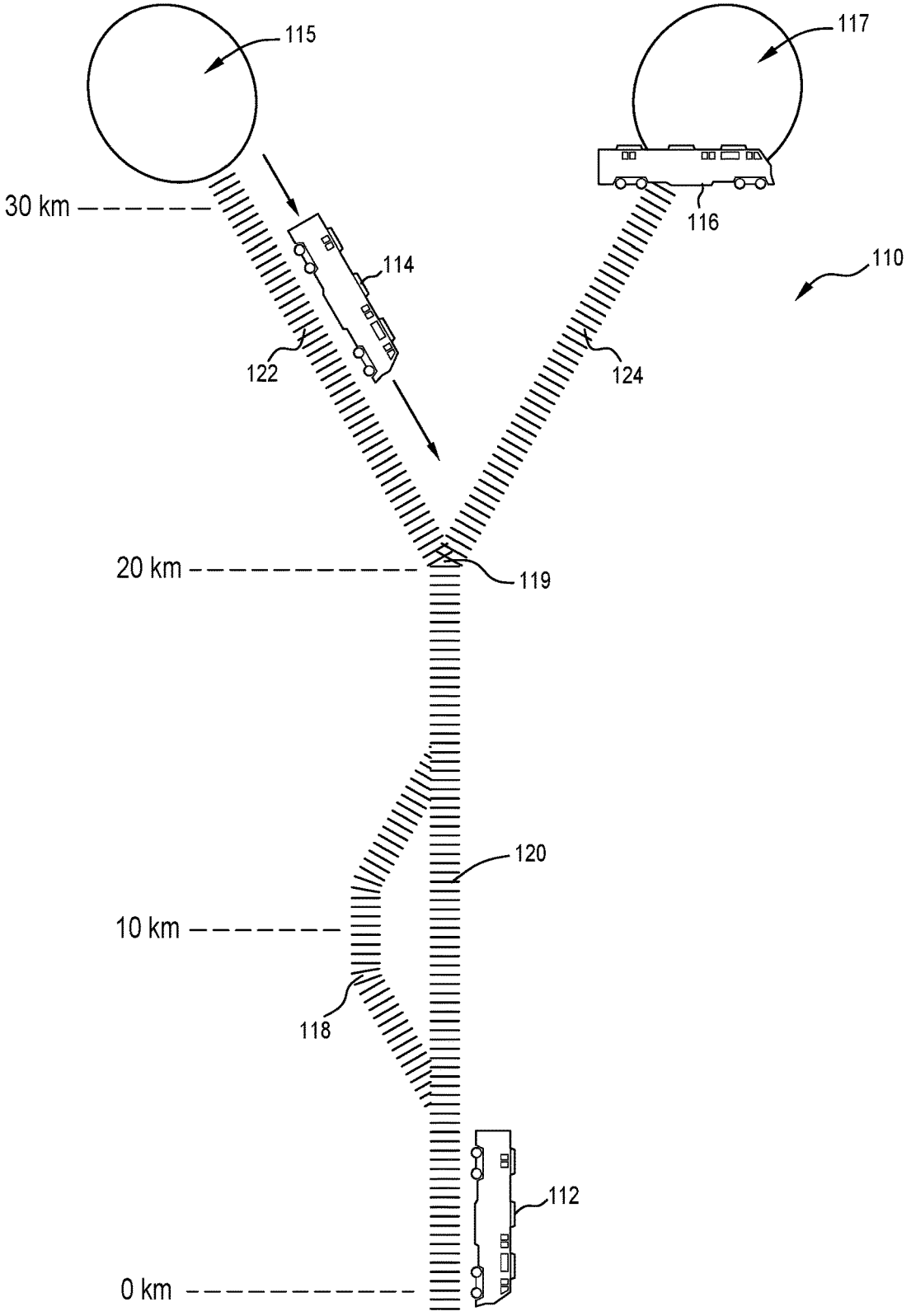
FIG. 6 is a diagrammatic representation of a portion of a further example rail track showing positions of 3 trains as the trains move along a main line of a rail network.

A further example representation of a portion 110 of a train line is shown in FIG. 6. The train line portion 110 includes a first train 112, a second train 114, and a third train 116. The train line includes a siding 118, a main line 120, a first line branch 122 and a second line branch 124. The first line branch 122 extends between a first 30 km location 115 and a fork location 119, and the second line branch 124 extends between a second 30 km location 117 and the fork location 119.

The first train 112 has moved to the 0 km location (corresponding to the port) and is stationary, the second train 114 is travelling on the first line branch 122 towards the 0 km (port) location, and the third train 116 has travelled away from the 0 km (port) location and is stationary at the second 30 km location 117.

Figure 7:
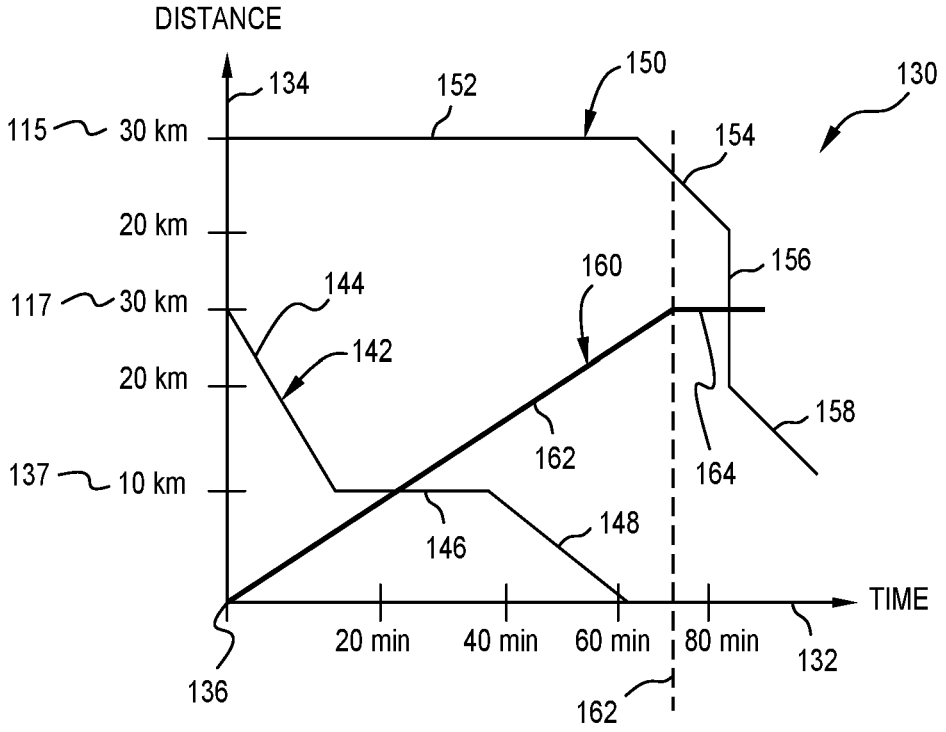
FIG. 7 is an example conventional train graph usable to plan and manage movements of the example trains on the rail network shown in FIG. 6.

A simple conventional train graph 130 representing the train line portion 110 shown in FIG. 6 is shown in FIG. 7.

The train graph 130 includes a time axis 132, a distance axis 134, an origin (port) location 136, a 10 km location 137, the first 30 km location 115 and the second 30 km location 117. The train graph 130 also includes a first train line 142 representing movement in time and space of the first train 112, a second train line 150 representing movement in time and space of the second train 114, and a third train line 160 representing movement in time and space of the third train 116. Also shown on the train graph 130 is a now line 162 representing the locations of the trains at the current time, and therefore portions of the first, second and third train lines 142, 150, 160 to the left of the now line 162 represent past locations of the first, second and third trains 112, 114, 116, and portions of the first, second and third train lines 142, 150, 160 to the right of the now line 108 represent future locations and therefore planned movements of the first, second and third trains 112, 114, 116.

As shown in FIG. 7, the first train line 142 includes a first line portion 144 representing movement of the first train 112 from the second 30 km location 117 to the 10 km location 137; a second line portion 146 during which the first train 112 is stationary at the 10 km location 137 for a period of approximately 20 minutes; and a third line portion 148 representing movement of the first train 112 from the 10 km location 137 to the 0 km (port) location 136. The second train line 150 includes a first line portion 152 representing that the second train 114 is stationary at the first 30 km location 115 for a period of approximately 60 minutes; a second line portion 154 representing movement of the second train 114 from the first 30 km location 115 to a 20 km location; a third line portion 156 that crosses the second 30 km location and represents passage of the second train past the fork location 119; and a third line portion 158 representing movement of the second train 114 from the fork location 119 towards the 0 km (port) location 136. The third train line 160 includes a first line portion 162 representing movement of the third train 116 from the 0 km (port) location 136 to the second 30 km location 117 for a period of approximately 70 minutes; and a second line portion 164 representing that the third train 116 is stationary at the second 30 km location.

It will be appreciated that the representation of the train line portion 110 shown in FIG. 6 represents the respective locations of the first, second and third trains 112, 114, 116 at the current time represented by the now line 162.

It will be understood that different locations on different branches of a line fork are shown separately on the train graph and movement of a train past the fork point is shown as a jump across the or each other location associated with the fork. For example, in the present example, first and second line branches 122, 124 associated with the fork location 119 are shown adjacent each other on the train graph 130 even though the corresponding line branches are not physically next to each other on the rail network, and movement of a train between the first line branch 122 and the main line 120 across the fork location 119 is shown as a vertical line.

Figure 8:
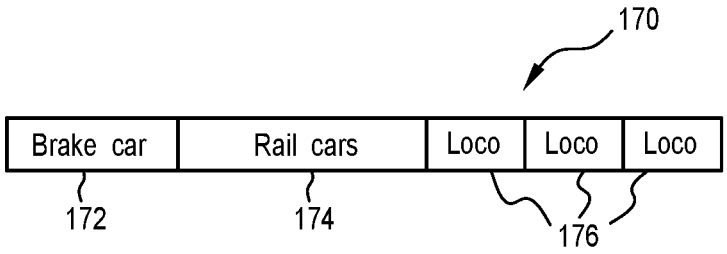
FIG. 8 is a diagrammatic representation of an example train that includes a brake car appliance, several rail cars and several locomotive appliances.

FIG. 8 diagrammatically illustrates an example train 170 that includes several train appliances. In this example, the train appliances include a brake car 172, a plurality of rail cars 174—referred to collectively in this specification as a 'tag', and a plurality of locomotives 176. Each appliance group is referred to in this specification as a 'container' and therefore the example train shown in FIG. 8 includes three containers—a first brake car container that includes one brake car 172, a second tag container that includes multiple rail cars 174, and a third loco container that includes three locomotives 176.

The present rail planning system 10 is arranged so that when a train 170 arrives at a port yard, the system is able to manage and plan movements of the train or to manage and plan movements of train containers separately, by providing a train graph that includes a separate line for each container and enabling a yard planner to selectively plan movements of each container separately of other containers or together with one or more of the other containers.

Figure 9:
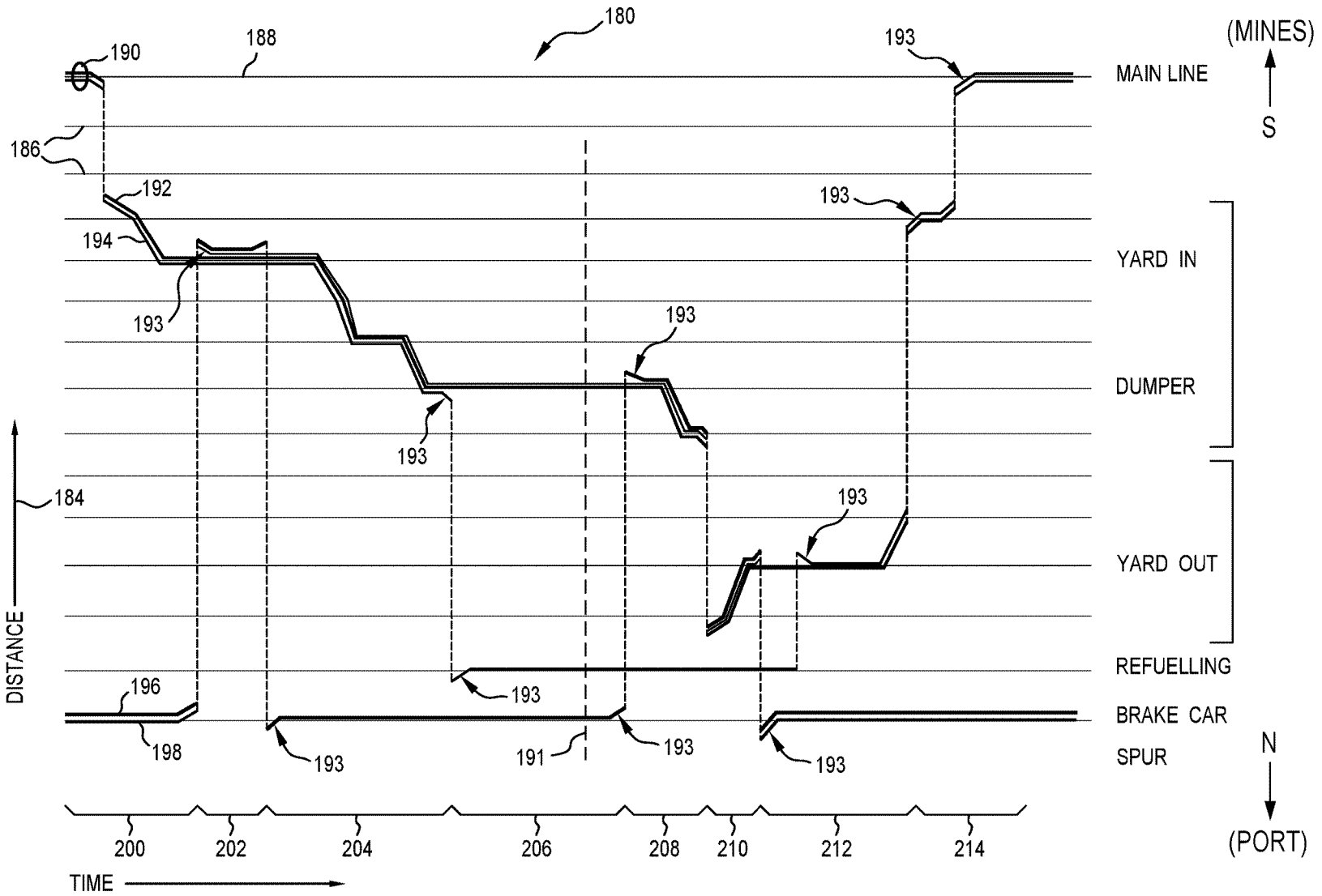
FIG. 9 is an example train graph produced by the system shown in FIG. 1.

An example yard train graph 180 usable to manage and plan movements of train containers at a port yard is shown in FIG. 9.

The yard train graph 180 includes a time axis 182 and a distance axis 184. The yard train graph 180 is similar to the train graph examples 90, 130 shown in FIGS. 5 and 7 in that diagonally extending lines represent movement; horizontal lines represent no movement; and vertical lines represent movement across fork locations.

The yard train graph 180 includes location lines 186 corresponding to locations at a port yard, including 'yard in' locations, 'dumper' locations, 'yard out' locations, 'refueling' locations, and a 'brake car spur' location; and a 'main line' location representing arrival of trains at the port yard from a main train line.

The yard train graph 180 includes a train 190 prior to arrival at the port yard, a tag container line 192 usable to represent movements and planned movements of a tag, a main line loco container line 194 usable to represent movements and planned movements of a main line loco container, a yard loco container line 196 usable to represent movements and planned movements of a yard loco container, and a brake car container line 198 usable to represent movements and planned movements of a brake car container.

The yard train graph 180 includes a now line 191 that represents the current time, and therefore portions of the container lines 192, 194, 196 and 198 to the left of the now line 191 represent past locations of the train containers, and portions of the container lines 192, 194, 196 and 198 to the right of the now line 191 represent future planned locations and therefore future movements of the train containers.

It will be understood that after each vertical line on the yard train graph 180 representing movement of one or more containers across a fork location, a stub line portion 193 is used to indicate the direction of travel of the container(s) as the container(s) enter a target location.

The example yard train graph shown in FIG. 9 represents the following container movements and planned container movements:

- During a first time period 200, a train including a main line loco appliance and a tag appliance arrives on the main line 188, and the train approaches the 'yard in' location from the south. Disposing the main line loco container line 194 to the north of the tag container line 192 indicates that the loco container is disposed in front of the tag. Also during the first time period 200, a yard loco container and a brake car container move from a 'brake car spur' location to the train at the 'yard in' location.
- During a second time period 202, the yard loco container and brake car container arrive at the 'yard in' location from the south. The brake car container attaches to the train at the 'yard in' location with the brake car container disposed to the south of the tag container and therefore behind the tag container.
- During a third time period 204, and after the brake car container has been moved to the train by the yard loco container, the yard loco container moves south back to the 'brake car spur' location. In order, the main line loco container, the tag container and the brake car container move north to the 'dumper' location.
- During a fourth time period 206, the tag container is unloaded at the 'dumper' location. As this occurs, the main line loco container moves south to a 'refueling' location where the loco appliances of the loco container are refueled.

During a fifth time period 208, and as the tag container is close to the end of dumping, the yard loco container moves north to the 'dumper' location, and pushes the brake car container and the tag container north to the 'yard out' location.

During a sixth time period 210, the yard loco container pushes the brake car container and the tag container south.

During a seventh time period 212, the yard loco container moves the break car container south back to the 'break car spur' location. Also, the main line loco container moves north from the 'refueling' location to the 'yard out' location and reconnects with the tag container, and the main line loco container and tag container begin to move south.

During an eighth time period 214, the main line loco container and tag container move south to the main line and subsequently move back towards the mine sites.

Figure 10:
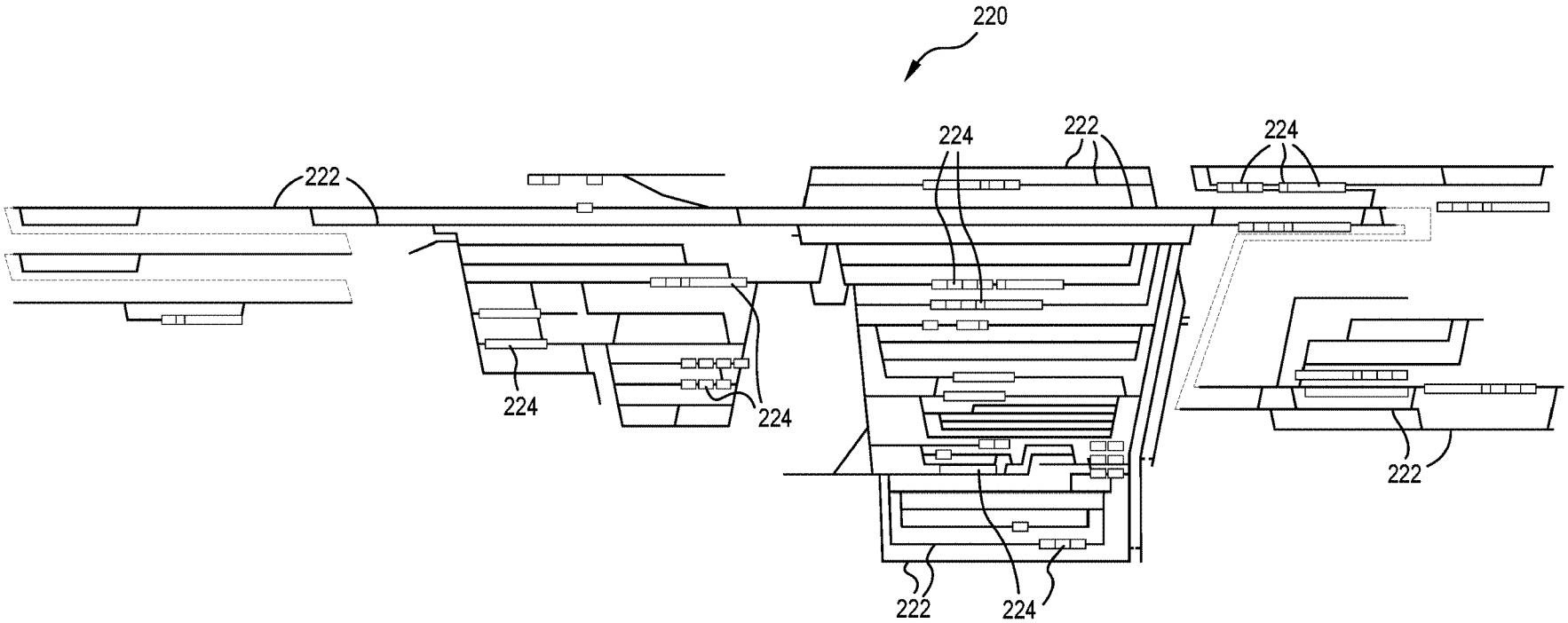
FIG. 10 is an example train control screen used in association with the train graph.

In addition to the yard train graph 180, the yard planner and/or the train controller have access to a train control screen 200, as shown in FIG. 10, that provides a visual representation of rail network tracks 222 present at the port yard, and an indication of the locations of train appliances 224 at the port yard.

The respective locations of the train appliances on the rail network may be determined in any suitable way. In this example, the system 10 includes a plurality of sensing devices distributed along the rail network 40 and arranged to sense when a train or container passes, and to communicate this information to a suitable train control facility, for example that includes yard planners, train controllers and computing devices arranged to implement the rail planning system 10. However, any suitable arrangement for determining the locations of the trains and containers on the rail network 40 is envisaged. For example, the trains and containers may each be provided with a GPS device and a suitable communications device arranged to communicate location information determined by the GPS device to the remote train control facility, the sensed locations being used by the system to update the current location of the containers on the yard train graph.

It will be appreciated that the train control screen 220 provides a snapshot of the locations of trains and appliances at the port yard at a specified time, and therefore provides a more detailed graphical representation of the respective locations of trains and appliances than is provided by the yard train graph 180, which provides a representation of the locations of trains in time and space over past and future time periods.

In this example, a yard planner is able to define and modify planned (future) train and appliance movements at the port yard by interacting with the train graph application 16, for example by interacting with the yard train graph 180 by dragging lines on the yard train graph using a mouse, and/or by interacting with directly with the train graph application, for example using a suitable dialog box.

In particular, the system 10 is arranged to enable a yard planner to plan movement of each train appliance individually or collectively, and thereby produce a yard train graph 180 that defines planned movements of all appliances that arrive and leave a port yard. The yard train graph 180 and associated train control screen 220 may then be used by a train controller to implement movement of appliances, for example using appropriate Movement Authorities.

Figures 11, 12:
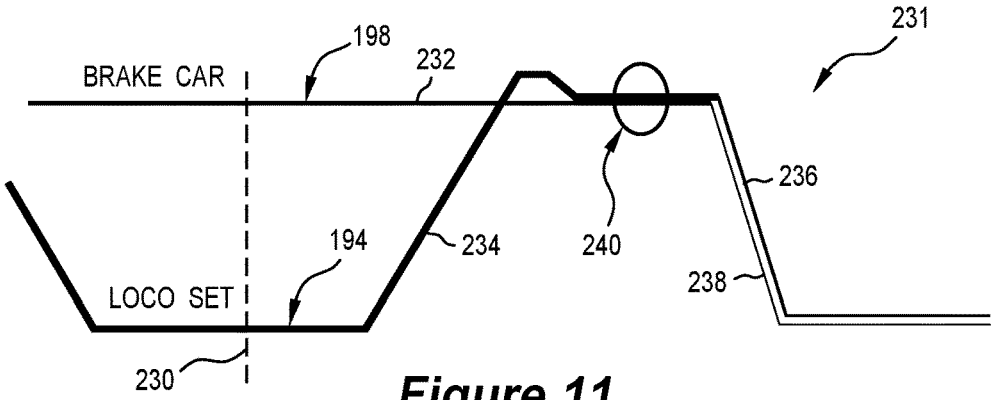
FIG. 11 is an enlarged representation of a portion of the train graph shown in FIG. 9.
FIG. 12 is a representation of an example container allocation table of the system shown in FIG. 1.

An example portion 231 of the yard train graph 180 is shown in FIG. 11.

The graph portion 231 includes the main line loco container line 194 and the brake car container line 198. The loco container and brake car container lines 194, 198 include respective locked line portions 232, 234 and respective unlocked line portions 236, 238. The locked line portions 232, 234 represent appliance movements that have been finalized by the yard planner in that the yard planner has considered the train planned appliance movements and made a decision that the planned movements should be implemented by the train controller. The unlocked line portions 236, 238 represent appliance movements that are contemplated by the yard planner but have not yet been finalized by the yard planner for implementation by the train controller.

In this example, the yard planner is able to lock planned container movements by selecting a position on the yard train graph corresponding to one or more lines and associated containers, for example using a mouse. In the example shown in FIG. 11, the yard planner has selected a location indicated by reference numeral 240 and as a consequence all parts of the main line loco container line 194 and the brake car container line 198 to the left of the selection location 240 are locked, and all locations of the main line loco container line 194 and the brake car container line 198 to the right of the selection location 240 remain unlocked. In this example, the locked line portions 232, 234 are shown in bold compared to the unlocked line portions 236, 238.

In the present example, the displayed yard train graph 180 is configurable by a user so as to change the displayed text, the colours used, the spacings between adjacent location lines 186, and so on.

For example, the following aspects of the displayed yard train graph 180 may be configurable:

x-axis timescale;

y-axis scale and labels for locations;

unlocked line styles—thickness, colour and style;

locked line style—thickness, colour and style;

line text and line text position relative to a line;

section group colour, for example so that different branches from a common fork point are shown using a different background colour.

The configurable aspects of the yard train graph 180 are stored in the data storage device 22 as the configuration data 24.

It will be appreciated that by using the yard train graph 180, a yard planner is able to define and/or modify a plan for movement of train appliances, and to finalise the planned movements for implementation by a train controller by interacting with the yard train graph 180, either directly, for example using a mouse, and/or indirectly by activating a suitable dialog box.

It will also be appreciated that by providing a separate line on the yard train graph 180 for each appliance set (brake car, loco or tag), and facilitating management and planning of movement of each appliance set independently, it is possible to efficiently manage and plan movements of trains and appliances associated with the trains at the port yard.

Data associated with the information represented by the yard train graph 180 is recorded in the data storage device as container data 26. The container data 26 includes information indicative of the location of the appliance at the yard, the appliance name, whether the appliance is connected to another appliance, and the appliance type. Interaction with the yard train graph 180 by a user, either directly or indirectly, causes the container data 26 to be modified to reflect the change.

In this example, the appliance data is stored in one or more databases that may be based on SQL protocols or any other suitable database protocol.

In this example, the database structure is an SQL structure that includes a container allocation database 250, an example portion of which is shown in FIG. 12, and a yard position table 260, an example portion of which is shown in FIG. 13.

In this example, the container allocation database 250 includes a container appliance type field 252 usable to define the type of appliance in the container, in this example a tag appliance, a non-tag appliance (any appliance other than a tag), a locomotive appliance or a brake car appliance; a yard field 254 usable to identify the yard at which the container is located; a container type ID field 256 usable to define a container type identifier for the appliance, each container type identifier being unique for a particular appliance type; and an appliance name field 258 usable to specify the or each name for the appliance(s) in each container.

The container allocation database 250 is particularly used to allocate container type identifiers to each container.

In this example, the yard position table 260 includes a container type ID field 262 that includes the information in the related container type ID field 256 of the container allocation database 250; a container position field 264 usable to specify the location of the container at the yard; a yard field 266 that includes the information in the related yard field 254 of the container allocation database 250; an appliance number field 268 usable to specify an appliance number for each container, the appliance number indicating the position order of each appliance at the position specified in the container position field 264; an appliance name field 270 that includes the information in the related appliance name field 258 of the container allocation database 250; a south connected flag field 272 usable to indicate whether an appliance is connected to the south; a north connected flag field 274 usable to indicate whether an appliance is connected to the north; a south appliance name field 276 usable to specify the appliance name of the south connected appliance; a north appliance name field 278 usable to specify the appliance name of the north connected appliance; an appliance type field 280 that includes the information in the related appliance type field 252 of the container allocation database 250; an x position offset field 282 usable to specify an x axis offset value; and a y position offset field 284 usable to specify a y position offset value. The x and y offset values are used to take into account different sizes of appliance type graphics and the associated physical offset locations on a display screen.

The yard position table 260 shown in FIG. 13 represents current information related to the containers and associated appliances.

A yard position table (not shown) that is similar to the yard position table 260 shown in FIG. 13 may be used to record future information related to the containers and associated appliances.

Figure 15:
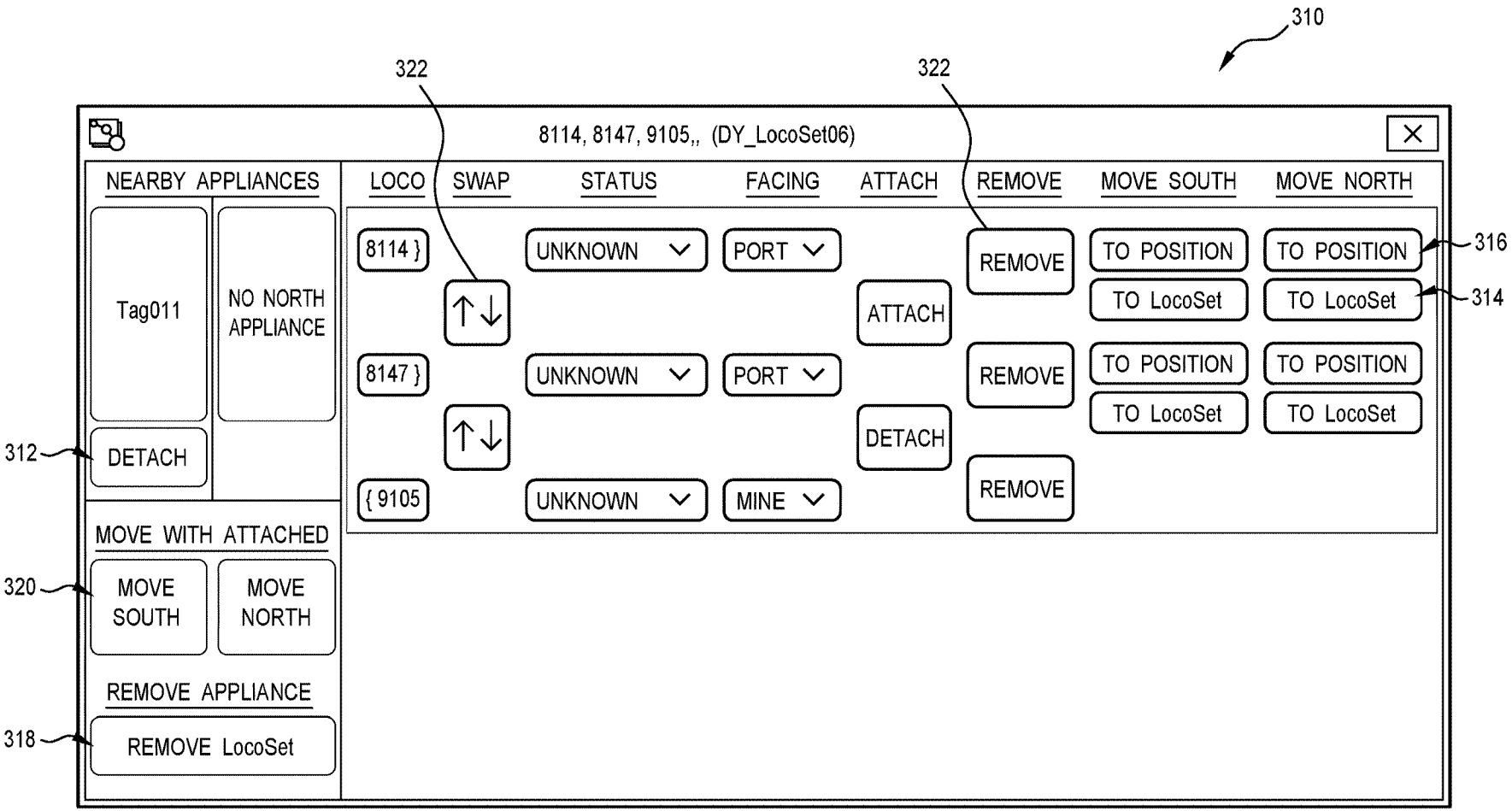
FIG. 15 is a representation of a control panel of the train graph application of the system shown in FIG. 1.

In this example, a yard planner manages and plans future changes to the container data 26 and thereby the displayed yard train graph 180 by directly manipulating the container lines 192, 194, 196, 198 on the yard train graph 180, and/or by using a dialog box 310, as shown in FIG. 15, that for example is activated by right clicking on a container line associated with container data desired to be changed.

Figure 14:
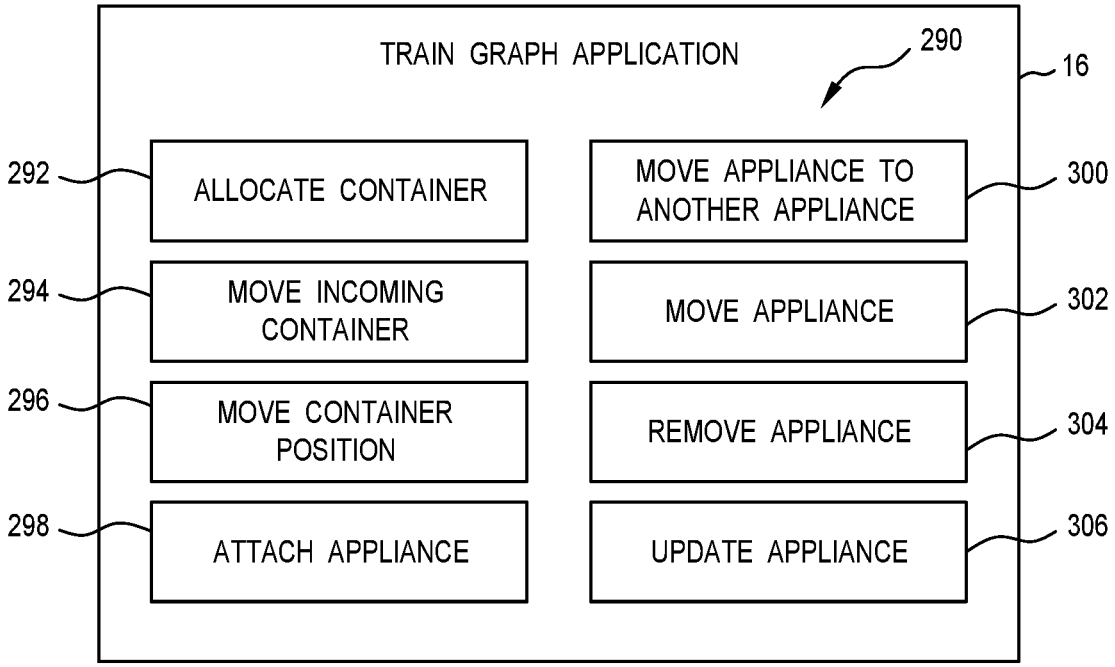
FIG. 14 is a schematic conceptual diagram illustrating procedures implemented by a train graph application of the system shown in FIG. 1.

Changes to the container data 26 are actioned using train graph application procedures 290, as shown in FIG. 14, that are selectively implemented by the train graph application 16 in response to user input.

In this example, the train graph application procedures 290 include:

- an allocate container procedure 292 usable to allocate a yard position for a container and specify x and y offset values for each container;
- a move incoming container procedure 294 usable to add a new container to a yard, for example so as to plan arrival of a train container at the yard;
- a move container position procedure 296 usable to move a container to a new position and also move any containers connected to it;
- an attach appliance procedure 298 usable to attach/detach an appliance to/from another appliance and thereby update the south/north connected flag field 272, 274 and the south/north appliance name field 276, 278;
- a move appliance to another appliance procedure 300 usable to move an individual appliance of a container to another container, such as an individual locomotive of a locomotive set to another locomotive set;
- a move appliance procedure 302 usable to move an individual appliance of a container to a different location;
- a remove appliance procedure 304 usable to remove an appliance, for example because the appliance has been decommissioned or is to undergo maintenance; and
- an update appliance procedure 306 usable to change the name of an appliance.

FIG. 15 illustrates an example dialog box 310 activated by a yard planner for a locoset container that includes locomotives 8114, 8147 and 9105, for example by right clicking on a main line loco container line 194 and selecting a button on the dialog box 310.

In this example, the dialog box 310 includes attach/detach appliance buttons 312 that when activated calls the attach appliance procedure 298; move appliance to another appliance buttons 314 that when activated calls the move appliance to another appliance procedure 300; move appliance buttons 316 that when activated calls the move appliance procedure 302; a remove appliance button 318 that when activated calls the remove appliance procedure 304; move connected appliances buttons 320 that when activated calls the move container position procedure 296; and update appliance buttons 322 that when activated call the update appliance procedure 306.

FIG. 16 shows an example scenario wherein a train including several containers is moved at a yard between position A and position B by a yard planner using the yard train graph 180 and associated train graph application 16.

FIG. 16 includes a train representation 330 indicative of a train that includes a brake container (CB01) 332, a tag container (Tag001) 334 and a loco container 336 (1234, 4567, 8901). The yard planner desires to move the train, including all connected containers, from position A 338 to position B 340 at the port yard. As indicated by reference numeral 341, before actioning the planned movement, the train 330 is disposed at position A 338 and an individual brake car set (CB302) 342 is disposed at position B 340.

Using the train graph application 16, the yard planner activates the dialog box for the train 330, for example by right clicking on one of the lines associated with the connected containers of the train 330, calls the move container position procedure 296, and enters the new position for the connected containers associated with the train 330. As a consequence, the train 330 changes on the yard train graph 180 to the second position 340.

Representations of portions of the yard position table 260 before 350 and after 352 movement of the train 330 are also shown in FIG. 16. As shown, the container data 26 in the yard position table 260 changes to reflect the changes to the position in the yard of the brake container (CB01) 332, tag container (Tag001) 334 and loco container 336 (1234, 4567, 8901). The appliance number 268 also changes as this field indicates the position order of appliances at a particular location such that in this example the appliance number 268 of the individual brake car (CB302) 342 at position B changes from 1 to 4.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Modifications and variations as would be apparent to a skilled addressee are deemed to be within the scope of the present invention.

The invention claimed is:

1. A rail planning system for planning movement of trains, at least some trains comprising a plurality of containers, each container including at least one train appliance, the system comprising:

a data storage device arranged to store container data indicative of:

the or each appliance associated with each container; and planned future locations of the containers;

the system arranged to produce data indicative of a train graph for display, the train graph including a separate line for each container, each line indicative of the planned locations in time and space of a container; and the system including an interface arranged to facilitate modification by a user of a planned location of a container and thereby modification of the line associated with the container on the train graph.

2. A rail planning system as claimed in claim 1, wherein the interface is arranged to:

enable a user to attach a first container to a second container, and to facilitate modification of the planned location of the first and second containers together, and/or enable a user to detach a first container from a second container so that the planned location of the first and second containers are modifiable separately.

3. A rail planning system as claimed in claim 1, wherein the interface is arranged to enable a user to simultaneously lock or unlock one or more lines on the train graph, wherein each locked line is indicative of a container movement that is considered to be finalised for implementation, and each unlocked line is indicative of a container movement that is contemplated but has not yet been finalised for implementation.

4. A rail planning system as claimed in claim 3, wherein a line on the train graph is lockable by a user selection of a location on the line, wherein the user selection of the location on the line corresponds to a defined time, and the system is arranged such that all locations on the line corresponding to a previous time to the defined time are also locked.

5. A rail planning system as claimed in claim 1, wherein the interface is arranged to facilitate modification by a user of the planned location of a container and thereby modification of the line on the train graph associated with the container either: by facilitating movement of a displayed line on the train graph using a human interface device; using a dialog box; or both.

6. A rail planning system as claimed in claim 1, wherein the container data includes an appliance number for each container, the appliance number indicative of a position order of a container at a location.

7. A rail planning system as claimed in claim 1, wherein the train graph includes a time x-axis and a distance y-axis, wherein diagonally extending lines represent movement, horizontal lines represent no movement, and vertical lines represent movement across fork locations.

8. A rail planning system as claimed in claim 1, wherein the train graph includes at least one of:

a now line indicative of locations of containers at a current time;

a past location indicator for at least one line indicative of a past location of a container; and a stub line portion indicative of a direction of travel of a container as the container moves to a new location.

9. A rail planning system as claimed in claim 1, wherein the system includes a plurality of sensing devices arranged to sense locations of containers, the sensed locations being used by the system to update current locations of the containers on the train graph.

10. A rail planning system as claimed in claim 1, wherein the system is arranged to display a train control screen that displays a representation of available container locations and provides a snapshot of locations of containers at a selected time.

11. A method of planning movement of trains, at least some trains comprising a plurality of containers, each container including at least one train appliance, the method comprising:

storing container data indicative of:

the or each appliance associated with each container; and planned future locations of the containers;

displaying a train graph that includes a separate line for each container, each line indicative of planned locations in time and space of a container; and facilitating modification by a user of a planned location of a container using an interface and thereby modification of the line associated with the container on the train graph.

12. A method as claimed in claim 11, comprising either or both of:

enabling a user to attach a first container to a second container and to facilitate modification of the planned location of the first and second containers together using the interface; and enabling a user to detach a first container from a second container using the interface so that the planned location of the first and second containers are modifiable separately.

13. A method as claimed in claim 11, comprising enabling a user to simultaneously lock or unlock one or more lines on the train graph using the interface, wherein each locked line is indicative of a container movement that is considered to be finalized for implementation, and each unlocked line is indicative of a container movement that is contemplated but has not yet been finalized for implementation.

14. A method as claimed in claim 13, wherein a line on the train graph is lockable by a user selection of a location on the line, wherein the user selection of the location on the line corresponds to a defined time, and the method comprises locking all locations on the line corresponding to a previous time to the defined time.

15. A method as claimed in claim 11, comprising facilitating modification by a user of the planned location of a container using the interface and thereby modification of the line on the train graph associated with the container by facilitating movement of a displayed line on the train graph using a human interface device.

16. A method as claimed in claim 11, wherein the container data includes an appliance number for each container, the appliance number indicative of a position order of a container at a location.

17. A method as claimed in claim 11, wherein the train graph includes a time x-axis and a distance y-axis, wherein diagonally extending lines represent movement, horizontal lines represent no movement, and vertical lines represent movement across fork locations.

18. A method as claimed in claim 11, wherein the train graph includes at least one of:

a now line indicative of locations of containers at a current time;

a past location indicator for at least one line indicative of a past location of a container; and a stub line portion indicative of a direction of travel of a container as the container moves to a new location.

19. A method as claimed in claim 11, comprising sensing locations of containers using a plurality of sensing devices, and using the sensed locations to update current locations of the containers on the train graph.

20. A method as claimed in claim 11, comprising displaying a train control screen that includes a representation of available container locations and provides a snapshot of locations of containers at a selected time.

* * * * *